US007931570B2

(12) United States Patent
Hoffman

(10) Patent No.: US 7,931,570 B2
(45) Date of Patent: Apr. 26, 2011

(54) EXERCISE DEVICE

(75) Inventor: Jonathan Hoffman, Herzelia Pituach (IL)

(73) Assignee: Balanced Body, Inc., Sacramento, CA (US)

( * ) Notice: Subject to any disclaimer, the term of this patent is extended or adjusted under 35 U.S.C. 154(b) by 0 days.

(21) Appl. No.: 12/162,761

(22) PCT Filed: Nov. 29, 2006

(86) PCT No.: PCT/US2006/045772

§ 371 (c)(1),
(2), (4) Date: Nov. 19, 2008

(87) PCT Pub. No.: WO2007/089324

PCT Pub. Date: Aug. 9, 2007

(65) Prior Publication Data

US 2010/0016131 A1 Jan. 21, 2010

(30) Foreign Application Priority Data

Jan. 30, 2006 (IL) ..... 173449
Jan. 30, 2006 (IL) ..... 173450

(51) Int. Cl.
*A63B 21/02* (2006.01)
*A63B 21/04* (2006.01)

(52) U.S. Cl. ..... 482/123; 482/129

(58) Field of Classification Search ..... 482/95, 482/96, 129, 130, 146, 147, 907, 123, 133
See application file for complete search history.

(56) References Cited

U.S. PATENT DOCUMENTS

| | | | | |
|---|---|---|---|---|
| 3,559,986 | A | | 2/1971 | Ehrmantraut |
| 3,582,069 | A | | 6/1971 | Flick et al. |
| 3,641,601 | A | | 2/1972 | Sieg |
| 4,402,506 | A | | 9/1983 | Jones |
| 4,512,571 | A | | 4/1985 | Hermelin |
| 4,679,786 | A | | 7/1987 | Rodgers |
| 4,706,953 | A | * | 11/1987 | Graham ..... 482/96 |
| 4,781,372 | A | | 11/1988 | McCormack |
| 4,884,802 | A | * | 12/1989 | Graham ..... 482/130 |
| 5,042,797 | A | * | 8/1991 | Graham ..... 482/96 |
| 5,066,005 | A | | 11/1991 | Luecke |
| 5,279,530 | A | | 1/1994 | Hess |

(Continued)

FOREIGN PATENT DOCUMENTS

FR 1486082 6/1967

(Continued)

OTHER PUBLICATIONS

SRF Board (Stabilization, Rotation and Function) from Fitter First, retrieved online on Feb. 22, 2009, at: http://www.fitter1.com/Catalog/Items/SRF.aspx.

(Continued)

*Primary Examiner* — Allana Lewin
(74) *Attorney, Agent, or Firm* — Greenberg Traurig LLP

(57) ABSTRACT

A versatile exercise device comprising a level frame; a frame keyhole sequence; a track parallel to two sides of the frame; at least one resistance medium, and a platform comprising at least two wheels, placed and rolling within said track, a platform frame comprising a platform keyhole sequences, and a top panel. The resistance mediums connect the platform to the frame. Preferably, each of two resistance mediums connects one side of the platform with one side of the frame.

15 Claims, 11 Drawing Sheets

U.S. PATENT DOCUMENTS

| | | | | |
|---|---|---|---|---|
| 5,295,935 | A | 3/1994 | Wang | |
| 5,342,264 | A | 8/1994 | Gordon | |
| 5,429,567 | A | 7/1995 | Gerschefske et al. | |
| 5,499,957 | A | 3/1996 | Metcalf et al. | |
| 5,499,958 | A | 3/1996 | Hess | |
| 5,520,598 | A | 5/1996 | Little | |
| 5,620,403 | A | 4/1997 | Lundin | |
| 5,769,755 | A | 6/1998 | Henry et al. | |
| 5,807,211 | A | 9/1998 | Berryhill | |
| 5,879,275 | A | 3/1999 | Aruin | |
| 6,338,704 | B1 * | 1/2002 | Endelman | 482/142 |
| 6,663,540 | B1 | 12/2003 | Huang | |
| 6,672,994 | B1 | 1/2004 | Stearns et al. | |
| 6,676,576 | B1 | 1/2004 | Wu | |
| 6,733,428 | B2 * | 5/2004 | List | 482/132 |
| 6,837,838 | B2 | 1/2005 | List | 482/147 |
| 6,840,894 | B2 * | 1/2005 | Lerner | 482/124 |
| 6,926,646 | B1 | 8/2005 | Nguyen | |
| 6,926,650 | B2 | 8/2005 | Endelman et al. | |
| 6,981,932 | B1 * | 1/2006 | Huang et al. | 482/72 |
| 7,322,908 | B2 * | 1/2008 | DiGiacomo | 482/121 |
| 2002/0132706 | A1 * | 9/2002 | Sleamaker | 482/51 |
| 2003/0171190 | A1 | 9/2003 | Rice | |
| 2003/0216230 | A1 | 11/2003 | Wang | |
| 2004/0053752 | A1 | 3/2004 | Yang | 482/70 |
| 2005/0043151 | A1 | 2/2005 | Geeting et al. | |
| 2005/0113227 | A1 * | 5/2005 | Endelman et al. | 482/142 |
| 2006/0058164 | A1 | 3/2006 | Miller et al. | 482/87 |

FOREIGN PATENT DOCUMENTS

| | | |
|---|---|---|
| FR | 2615111 | 11/1988 |
| GB | 2031740 | 4/1980 |
| WO | WO 99/020352 | 4/1999 |

OTHER PUBLICATIONS

International Search Report and Written Opinion from corresponding International Application No. PCT/US2006/045772.

Supplemental European Search Report and Preliminary Examination Report from corresponding European Patent Application No. 06844651.7, dated Apr. 6, 2010.

International Search Report and Written Opinion from related International Application No. PCT/US2006/045615, mailed Mar. 21, 2007.

Office Action, dated Aug. 12, 2010, from co-owned European Patent Application No. 06844651.7.

* cited by examiner

FIG. 2A
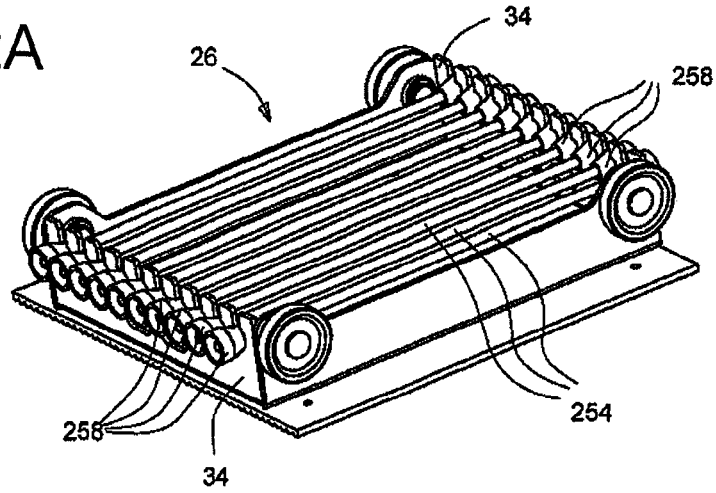
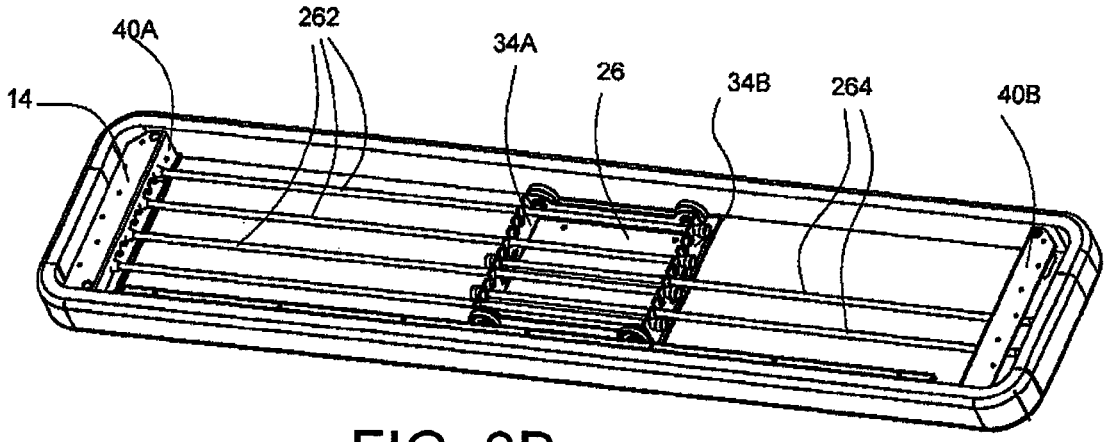
FIG. 2B
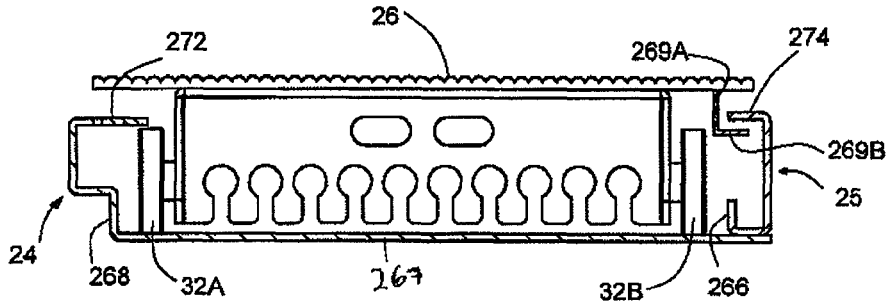
FIG. 2C

EXERCISE DEVICE

CROSS-REFERENCE TO RELATED APPLICATIONS

This application is a U.S. national stage filing under 35 U.S.C. 371 of International Application No. PCT/US2006/045772, filed on Nov. 29, 2006, which claims priority to Israeli Patent Application No. 173449, filed on Jan. 30, 2006, and to Israeli Patent Application No. 173450, filed on Jan. 30, 2006.

BACKGROUND OF THE INVENTION

1. Field of the Invention

The present invention relates to an exercise device which enables a user to perform a multiplicity of exercises that stimulate various areas of the body, in varying degrees of effort.

2. Discussion of the Related Art

A wide variety of exercise devices exist and are being used by people. Some devices are intended only for professional studios, due to their size, price, usage complexity, attention requirement or other reasons, while others may be used domestically. Some devices simulate naturally occurring motions, such as walking, but in a more controlled manner, while others enable the intensive activation of muscles which are hardly activated in other ways. There are devices which are intended to stimulate a single group of muscles, in a single way, where others are more versatile and enable the engagement of a plurality of muscle groups activating in the natural coordinated and synergistic manner. In addition, some devices enable a wide range of difficulty level, to fit the needs of various users, and to enable gradual increase in the effort for a specific user. There is also a limited number of devices suitable for under water usage. However, those devices are usually limited in the variety of their enabled exercises. There is high correlation between the mentioned characteristics, wherein the versatile multi-purpose devices are also more expensive, require a larger space, and might require professional guidance and attention. There is therefore a need for an exercise device that is inexpensive and small in size. However, the device should enable a wide variety of exercises, activating multiple body areas, in a wide range of difficulty levels and should have the ability to facilitate the engagement of a plurality of muscle groups activating in the natural coordinated and synergistic manner. The device should be suitable for use by trainees instructed by professionals, as well as by nonprofessional trainees at their home. The device should also be suitable for effective under-water training, without getting damaged.

SUMMARY OF THE PRESENT INVENTION

It is an object of the present invention to provide a novel exercise device. In accordance with the present invention, there is thus provided an exercise device comprising a level frame having two opposite ends; one or more platforms movably mounted on the frame such as to allow movement of the platform between the opposite ends of the frame; and one or more resistance mediums having one end connectable to the platform and a second end connectable to either one of the two opposite ends of the frame. Within the device, each of the frame opposite ends is optionally provided with a sequence of frame attaching elements and the platform is provided with one or more sequences of platform attaching elements, and one end of the resistance medium is connectable to any one of the platform attaching elements and the other end of the resistance element is connectable to any one of the frame attaching elements. The device can further comprise two or more resistance mediums, each having one end connectable to the platform and a second end connectable to either one of the two opposite ends of frame so as to allow connection of the platform to both opposite ends of the frame by means of said resistance medium. Within the device the resistance mediums are stored under the platform, in parallel to a top panel of the platform, when not in use. Each resistance medium can be a stretchable element. The platform can be provided with two spaced apart sequences of platform attaching elements, and the resistance medium have an equilibrium length equal or shorter than the distance between the two spaced apart sequences to allow storage of the resistance medium inside the platform by connecting one end of the resistance medium to an attaching element of one of the two sequences of platform attaching elements and the other end of the resistance medium to an attaching element of the second sequence of platform attaching elements. The one or more resistance mediums comprise an elastic band and a rigid conic terminator on either end of the elastic band. Within the device, each of the sequences of frame attaching elements and platform attaching elements can comprise a sequence of keyhole-like recesses adapted to receive an end of a resistance element. The resistance mediums can comprise a hydraulic mechanism or a vacuum mechanism. The resistance medium is optionally provided with a visual indicator for indicating resistance value. The visual indicator can be color or texture. The platform can comprise one or more wheels for moving the platform along the frame. The frame can comprise one or more tracks, generally stretching between the ends of the frame. Each of the tracks can comprise a cover, at least partially covering one or more parts of the platform. The platform can comprise a top panel. The top panel can comprise a shock absorbing layer. The platform optionally comprises an L shaped rotatable hook under the top panel. The device can further comprise one or more stopping pins and one or more stopper holes. The stopper holes holed in one or more strips, said strips being perpendicular to the ends of the frame. Within the device, the one or more platforms can be two platforms. The device can further comprise a rotational stand. The rotational stand optionally comprises a rotary plate, a frame, one or more holders connected to the rotary plate, one or more holders connected to the frame, and one or more resistance mediums. The device optionally comprises one or more handles. Each handle can be located at a desired height and at a desired distance from the level frame. The device can further comprise one or more hooks for hanging one or more sides of the device on an external stationary support. The device can further comprise a starting block, the block can be mounted on the top panel of the platform. The device optionally comprises an inclination mechanism. The device can further comprise a user guide, comprising exercises or precautions. The device optionally comprises one or more sensors attached to a user of the device while the user is performing one or more exercises, and an analysis device for receiving information from the sensor and providing the user with feedback related to the exercises. The level frame optionally comprises a treading area so that a user can place a foot on the treading area. The device can comprise one or more elevating components for elevating the device to a desired height. The device optionally comprises one or more padding elements, the padding elements placed on the frame or on the platform. The padding is optionally elastic, and optionally made of rubber or silicone or sponge.

Another aspect of the disclosed invention relates to a method for performing a physical exercise by a user wherein one or more parts of the user's body touches the device. Yet another aspect of the disclosed invention relates to a method for performing a physical exercise wherein a user keeps one limb stationary on a treading area connected to a frame by sliding a platform mounted on said frame by means of a second limb, wherein the sliding is performed back and forth in opposite directions, either forward and backward, or sideways, and wherein the user has to exert force in order to slide the platform in both directions.

Yet another aspect of the disclosed invention relates to a method for performing a physical exercise wherein a user holds an external stationary support with one or more first limbs, and uses one or more second limbs to slide a platform back and forth sideways, wherein the user has to exert force in order to slide the platform in both directions.

Yet another aspect of the disclosed invention relates to a method for performing a physical exercise wherein a user uses one or more limbs to slide one or more platforms back and forth laterally wherein the user has to exert force in order to slide the platform in both directions.

BRIEF DESCRIPTION OF THE DRAWINGS

FIG. 2A is a perspective view of the platform used in the disclosed invention in an upside-down position, in accordance with a preferred embodiment;

FIG. 2B is a perspective view of the exercise device of FIG. 1 in an upside-down position showing the attached resistance mediums;

FIG. 2C is a cross section through the tracks and the platform, in accordance with a preferred embodiment;

DETAILED DESCRIPTION OF THE PREFERRED EMBODIMENT

The present invention overcomes the disadvantages of the prior art by providing a novel exercise device. The device comprises one or more platforms movably mounted on one or more parallel tracks, the tracks being bounded by a level frame. The platforms, in addition to moving along the tracks, preferably connect to the sides of the frame perpendicular to the tracks by one or more resistance elements, such as rubber tubes or other resistance mediums, extending in parallel to the tracks. The resistance mediums can connect either one or both sides of the platform to one or two sides of the frame, respectively. When two or more elements connect one or two sides of the platform to one or two sides of the frame, different resistance values can be used. Using combinations of elements with various resistance value combinations, on one or two sides of the platform, enables a wide variety of exercises for activating multiple body parts, in various difficulty degrees. In one embodiment, each element preferably connects one side of the platform to the opposite side of the frame. For example the right side of the platform is connected to the left side of the frame. This arrangement facilitates easy and secure usage of the device. When the resistance mediums are not used, they are preferably stored under the platform such that on the one hand they will not interrupt the motion of the platform over the tracks or cause the user to stumble, and on the other hand are easily accessible for being easily connected or disconnected. Various enhancements can be added to the basic device, including a hook for hanging one side of the device on an external stationary support, such as a ladder or a handle to provide specific muscular facilitation, stopping pins to stop or limit the movement of the platforms along the tracks and the like.

Figure 1:
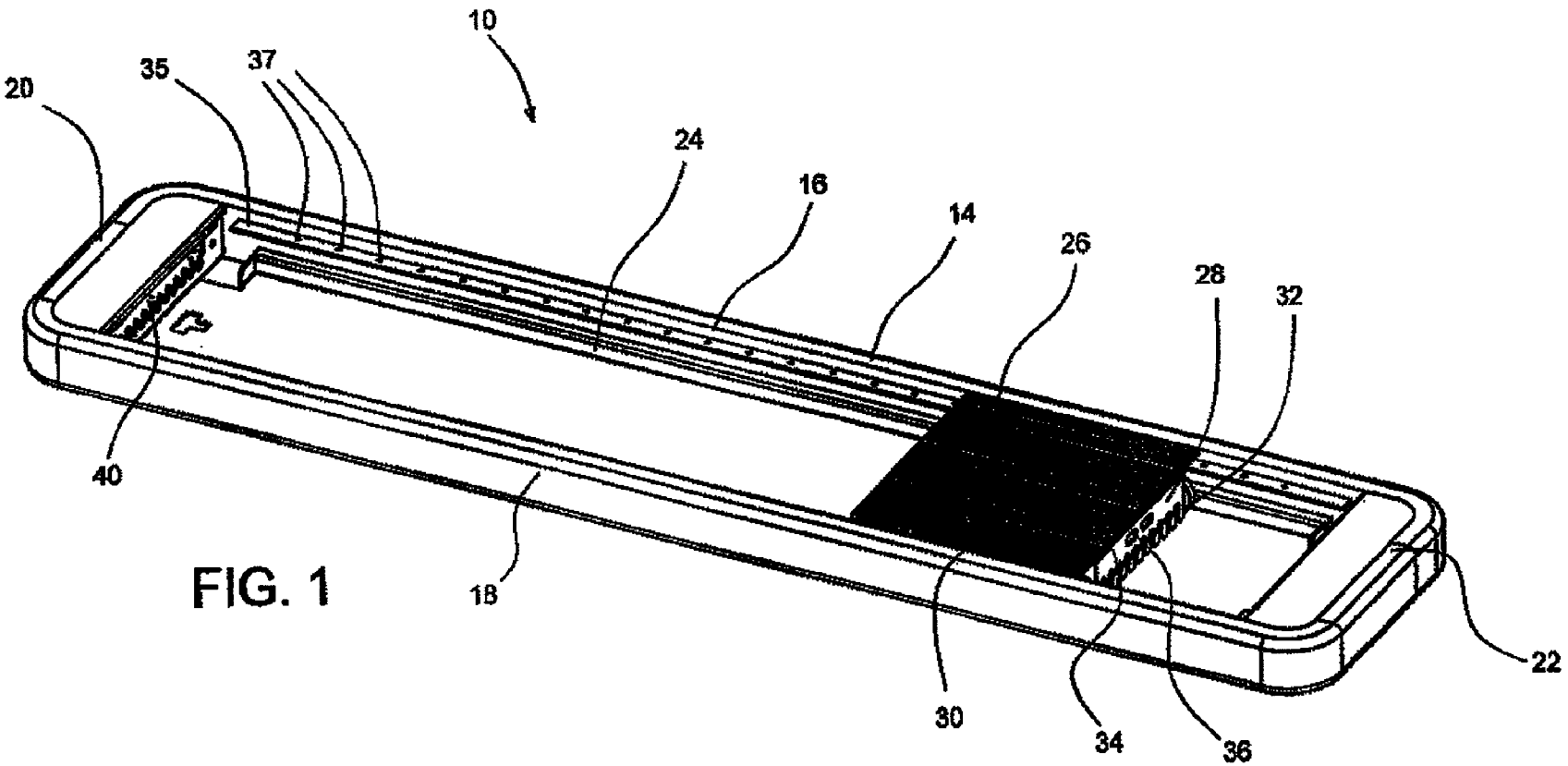
FIG. 1 is a perspective view of the disclosed exercise device, in accordance with a preferred embodiment of the disclosed invention.

Reference is now made to FIG. 1, which is a perspective view of a preferred embodiment of the disclosed exercise device. The device, generally referred to as 10, comprises a rigid frame 14 of a substantially rectangular shape, having two opposite sides 16, 18, and two opposite ends 20, and 22; a first track 24 running between ends 20 and 22 of the frame, in parallel to sides 16 and 18 of frame 14; a second track 25 (not shown) running in parallel to track 24; and a platform, generally referenced as 26 which moves along the tracks. Tracks 24 and 25 can run all the way from wall 20 to wall 22, or be shorter, and only reach the vicinity of walls 20 or 22. Tracks 24 and 25 can be attached to walls 16 and 18, or run a short distance away from them. Platform 26 comprises a frame 28, a flat top panel 30 mounted on frame 28, wheels 32, and a sequence of platform attaching elements, such as sequence of keyhole-like recesses 34 (best seen in FIG. 2A), wherein each keyhole-like recesses 34 is an attaching element. In accordance with the embodiment shown here, platform 26 is symmetric, and comprises four wheels 32, and two opposite sequences of keyhole openings as shown in FIG. 2A. Tracks 24 and 25 are further detailed in association with FIG. 2C below. When the device is used, wheels 32 roll inside tracks 24 and 25, thus moving platform 26 in parallel to walls 16 and 18 of frame 14. Since track 24 comprises a top cover 272 of FIG. 2C, wheels 32 are protected, so that the platform is not accidentally hurled from the tracks if the user activates unbalanced weight on an edge of platform 26. On, or in the vicinity of ends 20 and 22 of frame 14, frame 14 further comprises two sequences of frame attaching elements, such as panels provided with a sequence of keyhole-like recesses 40 (only the sequence for end 20 is seen in FIG. 1), which can connect to platform keyhole sequences of the platform via resistance mediums (not shown). Another component of frame 14 is a stopper holes strip 35, which comprises a multiplicity of holes 37. The holes are further discussed in association with FIG. 6 below. Frame 14 is preferably made of metal, wood, or any other rigid material. Preferably, the dimensions of the frame are of about 30 to 60 cm wide and of about 2 m long so as to allow an adult a comfortable standing with both feet between sides 16, 18 and a full, or nearly full straddling of both legs between ends 20,22. However, the dimensions of the device are independent of its structure, so a person skilled in the art will appreciate that larger and smaller devices can be designed using the disclosed invention. The tracks are preferably made of rigid material, such as an aluminum profile, iron, titanium or the like. Frame 28 and top panel 30 of platform 26 are also made of rigid material, so that the platform can bear the weight of an adult. Top panel 30 is preferably padded with a softer layer, such as rubber, in order to avoid knee and back damage from a user and provide traction for added user safety. The platform is preferably a few centimeters narrower than the frame, and should be long enough to allow an adult to fully position his foot on the platform, so the preferred dimensions of the platform are between about 15*15 cm and about 55*55 cm. Platform 26 further comprises holes 36 on either side, for allowing the user to insert his fingers in order to grip the platform while inserting and removing wheels 32 into and from tracks 24 and 25.

Referring now to FIGS. 2A and 2B, showing in more detail the structure of resistance mediums and platform 26 of FIG. 1. Platform 26 comprises generally rectangular frame 28, four wheels 32, each connected to frame 28 and rotating around axis 234. Two opposite sides of platform 26 are provided with a sequence 34A and 34B of recesses serving as attaching elements for connecting platform 26 to ends 20, 22 of frame 14 of FIG. 1 by means of resistance mediums. Sequence 34 typically comprises between 2 and 15 recesses, each having a neck 236 and a wider area, to enable the user multiple choice of resistance mediums when using the device. is. Neck 238 is typically 2 to 8 mm wide and 2 to 30 mm long, and wider area 242 is generally circular, with a diameter of about 3 to 15 mm. The resistance medium, generally referred to as 250, comprises band 254, preferably made of elastic material or structure such as rubber, metal springs or the like. With little or no tension, the length of each band is designed to be about the same as the distance between the two platform keyhole sequences 34A and 34B of platform 26. The diameter of band 254 is typically between 1 and 15 mm. Medium 250 further comprises on each end a conic terminator, preferably made of metal or another rigid material. In order to hold the tip of band 254 from slipping out of terminator 258, a bead made of rigid or semi-rigid substance 262 is threaded and fastened on band 254. Bead 262 is preferably coated by a soft layer to prevent abrasion and tearing of band 254. It will be appreciated by people skilled in the art that other embodiments for medium 250 can be designed and used. In order to connect or release medium 250 from the platform, either for usage or for storing, the user pushes band 250 through neck 238 to wider part 242 and releases. Conic terminator 258 fixates the medium and prevents it from pulling back. When the resistance mediums are not used, they are stored inside platform 26 as shown in FIG. 2A. FIG. 2A shows platform 26 with a multiplicity of resistance mediums 250 in a storage position, having bands 254 extending between opposite walls of the platform and terminators 258 protruding outwardly through recess sequences 34A and 34B. Since the equilibrium length of the mediums is about the same as or shorter than the distance between two platform keyhole sequences 34, the mediums do not entangle or touch the floor or the bottom part of the device. FIG. 2B is a bottom perspective view of the platform, frame and resistance medium during use. During use, platform 26 is connected to keyhole sequences 40A and 40B of frame 14, using two sets of resistance mediums, 262 and 264. Resistance mediums 262 connect the right sequence 34B of platform 26 to the left sequence 40A of frame 14, while resistance mediums 264 connect the left sequence 34A of platform 26 to the right sequence 40B of frame 14. This connection manner is convenient, since for each resistance medium to be used, the user only has to pull one end of the stored resistance medium from the platform and connect it to the frame, without having to release the other end of the resistance medium from the platform. Alternatively, if the user wishes, it is possible to place the resistance mediums so that they connect each side of the platform with the closer side of the frame, i.e., connect keyhole sequences 34A and 40A, or connect keyhole sequences 34B and 40B. In yet another alternative, the resistance mediums can connect two platforms used on the same track system.

Figure 3:
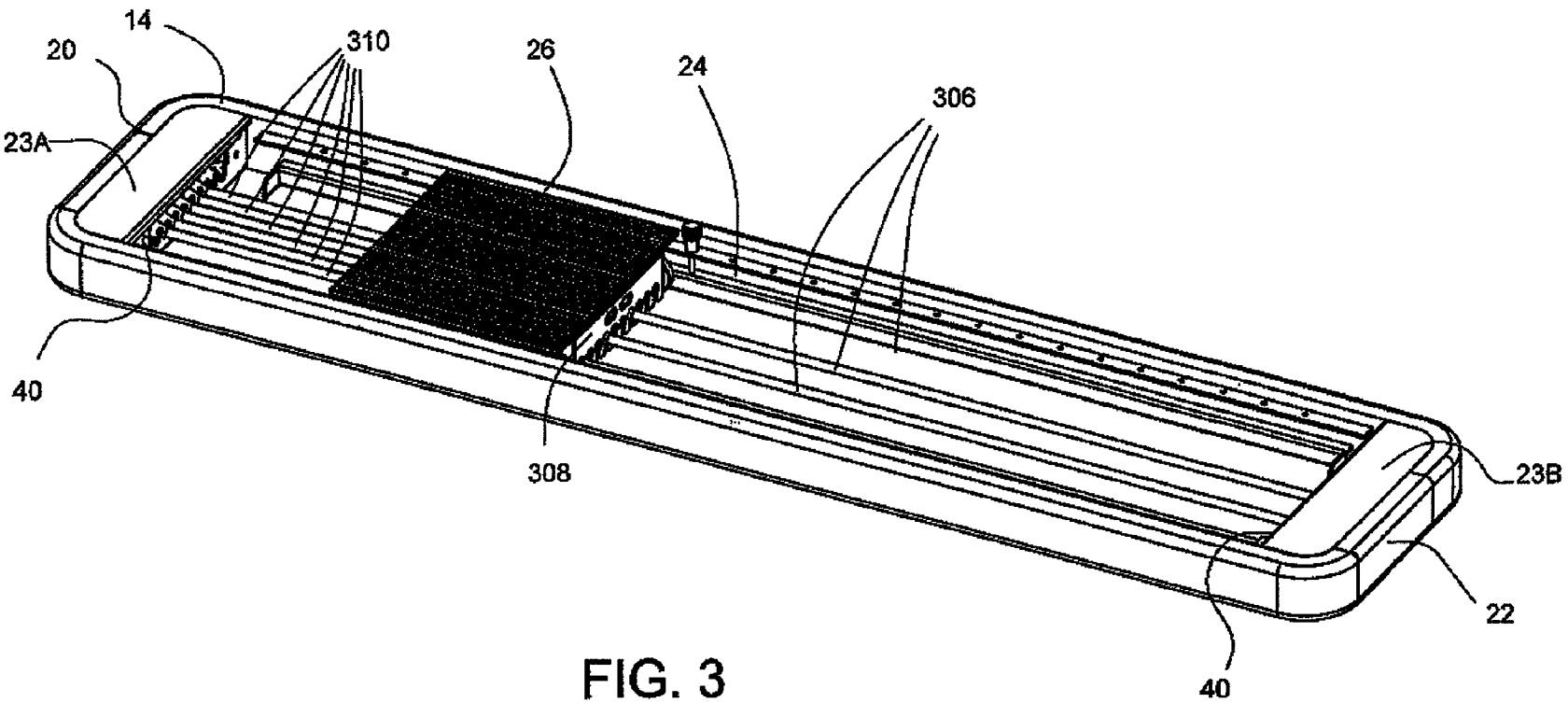
FIG. 3 shows a perspective view of the exercise device of FIG. 1 with the attached resistance mediums, in accordance with the preferred embodiment.

Referring now to FIG. 2C, showing a cross section through track 24 and second track 25 (not shown in FIG. 1 and FIG. 3). Tracks 24 and 25 comprise upper covers 272 and 274, respectively. Upper cover 272 partly covers wheels 32A, so that platform 26 is prevented from bouncing when imbalanced weight is activated. Track 25 preferably comprises vertical wall 266 to protect and direct the two wheels that roll in track 25, and prevent the platform from moving sideways. Track 24 preferably comprises a vertical wall 268 to protect and direct the two wheels that roll within track 24. In order to remove the platform from the track, a user needs to raise the platform in an angle from the side of track 25. For the user's safety, this operation is disabled on the side of track 24, due to cover 272 protecting wheels 32A. Optionally, platform 26 is featured with an L shaped rotatable hook, comprising a vertical part 269A and a horizontal part 269B. When the device is used, the hook is turned perpendicularly to the direction in which the platform moves along the tracks, so that the end of horizontal part 269B is positioned under cover 274, without getting in contact with cover 274, so the motion of platform 26 along the tracks is not interrupted. When the user wishes to remove the platform, he or she first has to rotate the hook in 90° around vertical part 269A, so that the end of horizontal part 269B is not under cover 274, and then proceed in removing as detailed above. This mechanism is designed to provide additional security, and further avoid hurling of the platform form the tracks. Tracks 24 and 25 are preferably manufactured such that horizontal part 267, which constitutes the lower part of track 24 comprises the bottom of the device. Tracks 24 and 25 may be manufactured as shown in FIG. 2C, but other profile combinations can be designed as well.

Referring now to FIG. 3, showing an exemplary use of the device with resistance mediums. Similarly to FIG. 1, platform 26 moves along tracks 24 and 25 (track 25 not shown) between ends 20 and 22 of frame 14. However, resistance mediums have been added, so that the movement of platform 26 along tracks 24, 25 requires more effort. In the example shown in FIG. 3, the user used a medium group 310, comprising six mediums, to connect side 308 of platform 26 to end 20 of frame 14 and a medium group 306, comprising three mediums, to connect the opposite side of platform 26 (not shown) to end 22 of the frame. It will be realized that the mediums within resistance group 306 do not have to be identical to each other, neither do the mediums of group 310. Either one or both of groups 306 and 310 can be connected to the frame. Each of the mediums in group 306 and group 310 can have different characteristics, such as resistance. The mediums can further have a visual characteristic, such as color or texture, to enable the user to easily select the mediums he or she needs. There is no requirement that group 306 and group 310 will be identical to each other, and any combination can be used. FIG. 4B shows that the resistance mediums are straight at all times, and never have to be bent, nor when in used neither when stored. The mediums being straight and not entangled, together with the locking mechanism of the keyholes and the conic terminators, assures that the mediums are never accidentally released when used, and thus the user is protected from injury. Treading areas 23A and 23B are preferably long enough and wide enough to enable a user to steadily place a foot or another limb on the same level of the device, while moving the platform with another limb, such as the other foot.

Figure 4A:
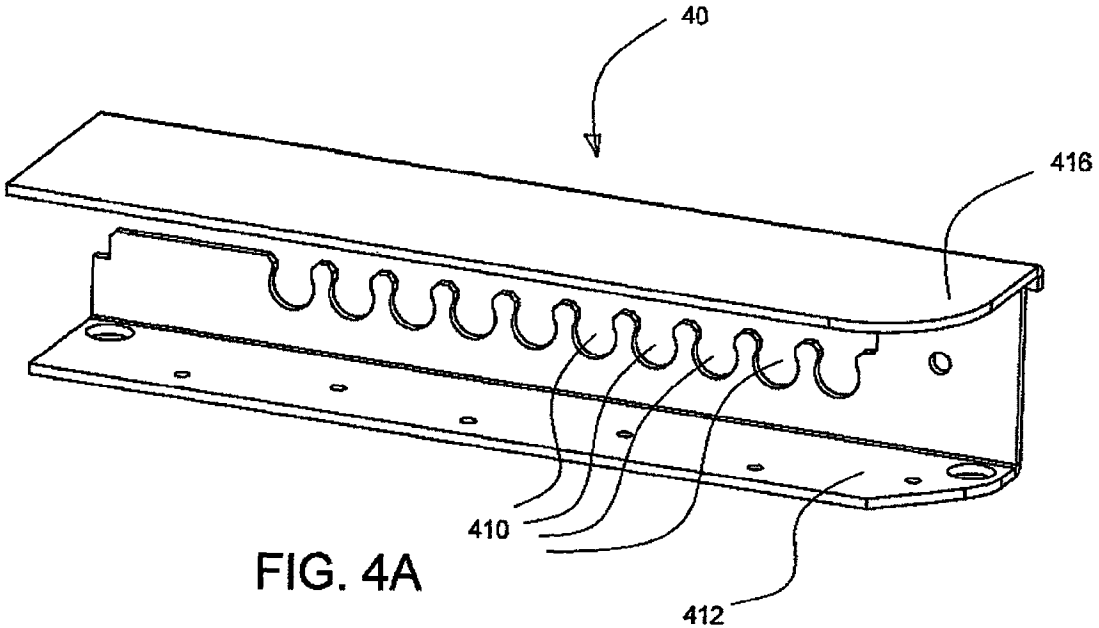
FIG. 4A is a perspective view of the frame part comprising the sequence of keyhole-like attaching elements in accordance with the preferred embodiment.
Figure 4B:
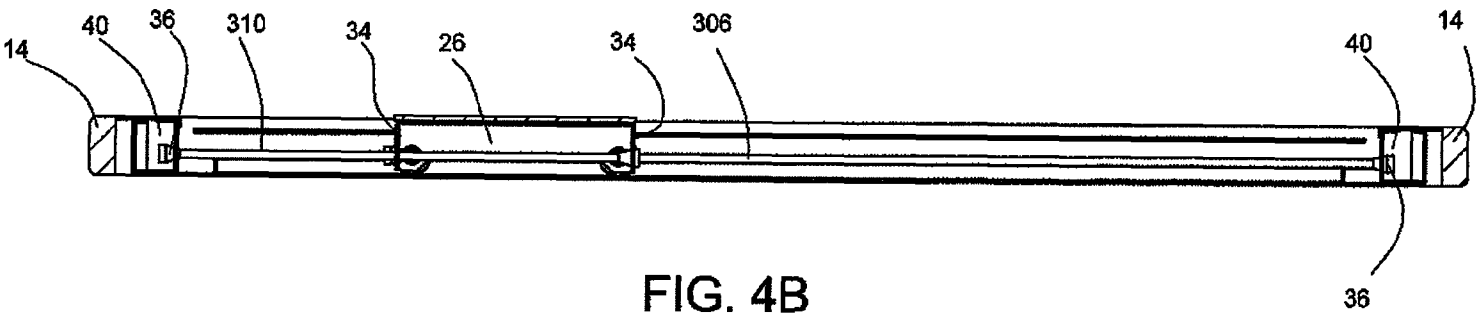
FIG. 4B is a longitudinal cross sectional view of the exercise device with attached resistance mediums, in accordance with the preferred embodiment.

Referring now to FIG. 4A, showing the frame panel with keyhole sequence 40 of FIG. 1. Preferably, the openings of keyholes 410 in frame keyhole sequence 40 face upward, while the necks of keyholes in platform keyhole sequence 34 face downward. This is mainly for manufacturability and usage comfort reasons. However, other solutions can be designed, which are still covered under the scope of the disclosed invention. Frame keyhole sequence 40 further comprises top shim 416 and bottom shim 412 for fastening to the frame.

FIG. 4B shows a sectional view through the disclosed device, with resistance mediums connecting the platform and the frame. Keyhole sequences panels 40 are connected to frame 14 of the device. Platform 26 is connected on its right side with resistance medium 310 to the left side of the frame, and on its left side with resistance medium 306 to the right side of the frame. Terminators 36 of mediums 306 and 310 prevent the mediums from slipping through keyholes in keyhole sequences 34 or 40.

Figure 5A:
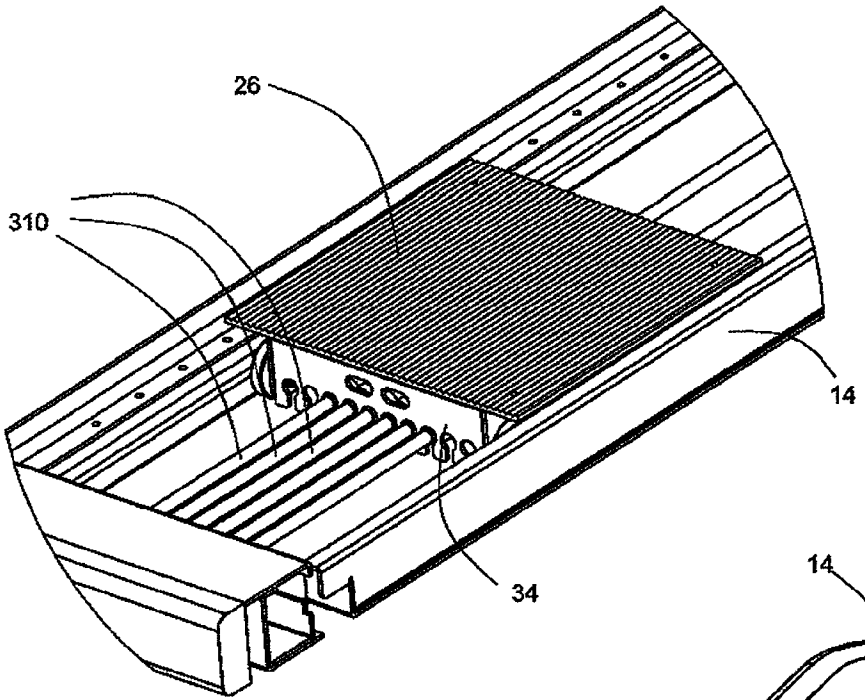
FIGS. 5A and 5B are two partial perspective views showing the connection between the mediums and the platform and between the mediums and the frame, in accordance with the preferred embodiment.

FIG. 5A is a partial perspective view of the platform mounted within the frame, with attached resistance mediums 310. Resistance mediums 310 connect to platform 26 through the keyholes in keyhole sequence 34.

Figure 5B:
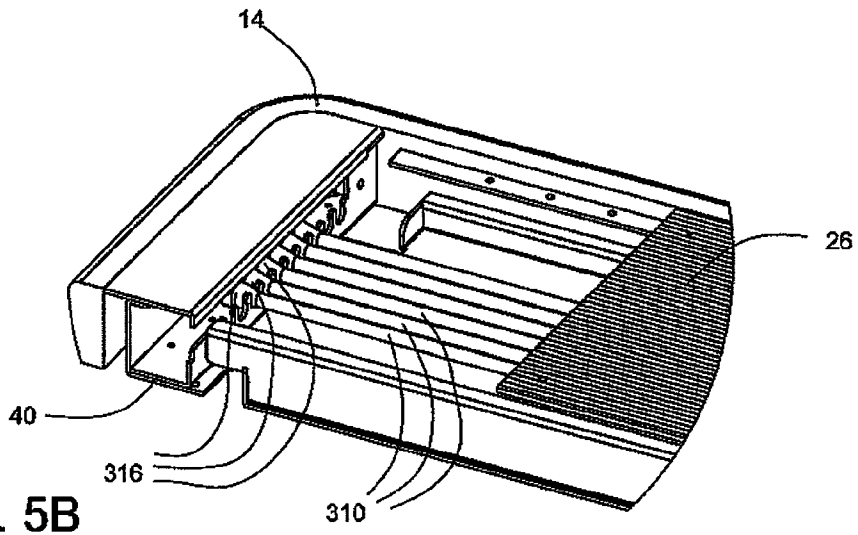

FIG. 5B is a partial perspective view of frame 14 and platform 26, with attached resistance mediums 310. Resistance mediums 310 connect to frame 14 through the holes in frame keyhole sequence 40. Terminators 316 stop mediums 310 from slipping through the holes and releasing.

Figure 6B:
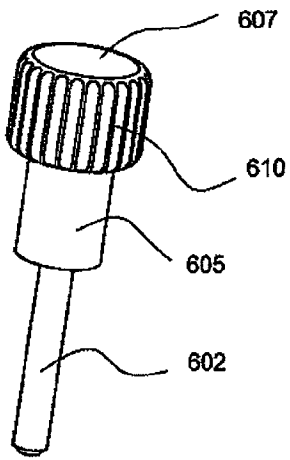
FIG. 6B shows the stopper pin, in accordance with a preferred embodiment.
Figure 6A:
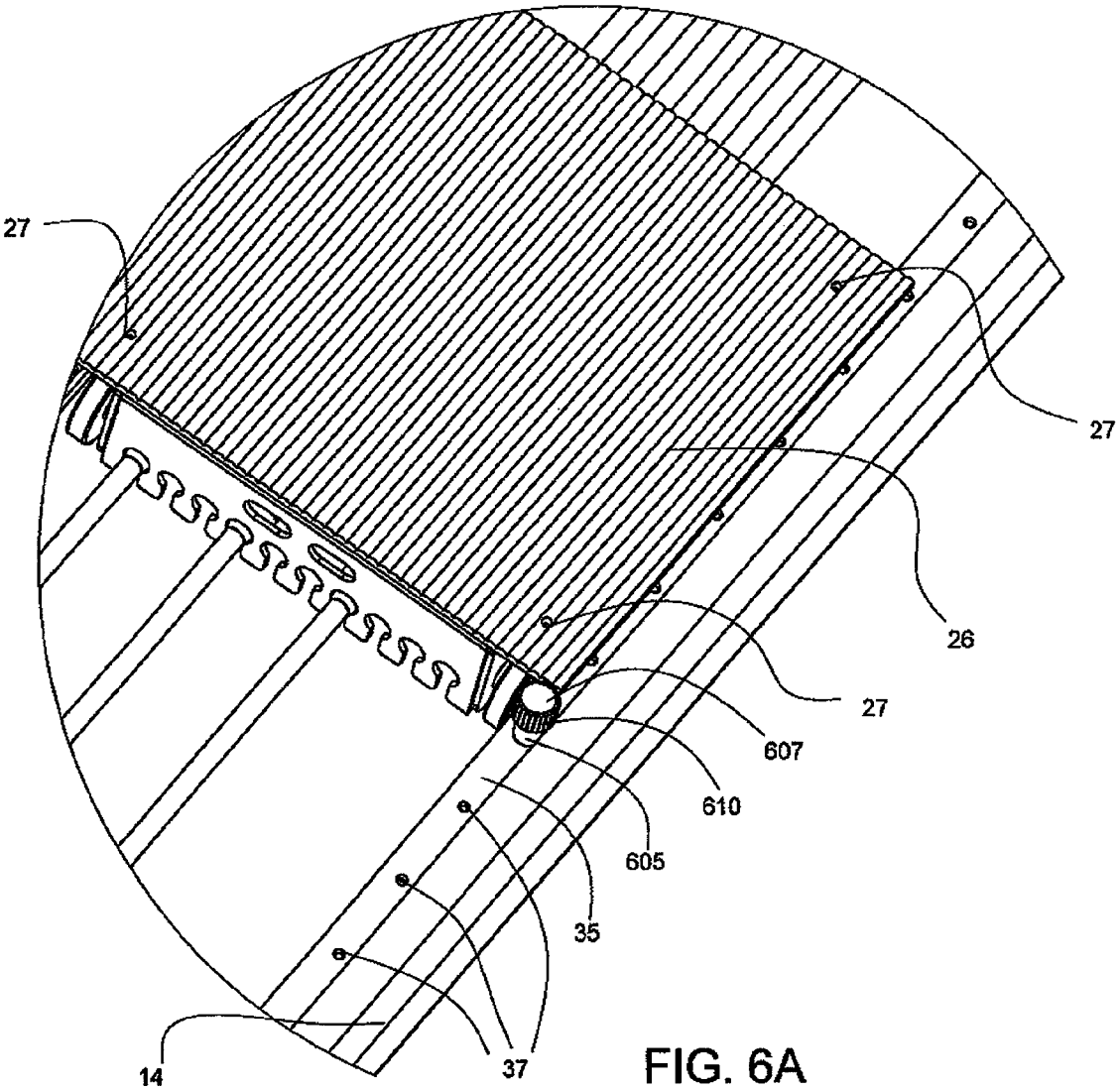
FIG. 6A is a partial perspective view of frame and mounted platform showing stopper holes and a stopper pin, in accordance with a preferred embodiment.

FIG. 6 shows a perspective view of part of frame 14 and stopper holes strip 35, wherein a stopper pin is inserted into one of holes 37 and FIG. 6B shows the stopper pin. The stopper pin comprises an inserted part 602, which is inserted into any of holes 37, a protruding part 605, which is of a larger diameter than inserted part 602, and an upper part 607. Parts 602, 605 and 607 are preferably made of metal, wood or another sturdy material. Upper part 607 is preferably at least partially surrounded by a layer 610 of soft and shock absorbing material such as rubber, so as not to cause sharp and noisy collision between platform 26 and the pin. In another preferred embodiment, parts 605 and 607 can be a single component, a part or all of which can be wrapped by layer 610. When the movement range of platform 26 is limited not by the ends of the tracks, but by at least one stopper pin, the length of the track is effectively shortened, or reduced to zero, thus preventing any movement of the platform upon the track, which is useful for certain exercise groups.

Figures 7, 8:
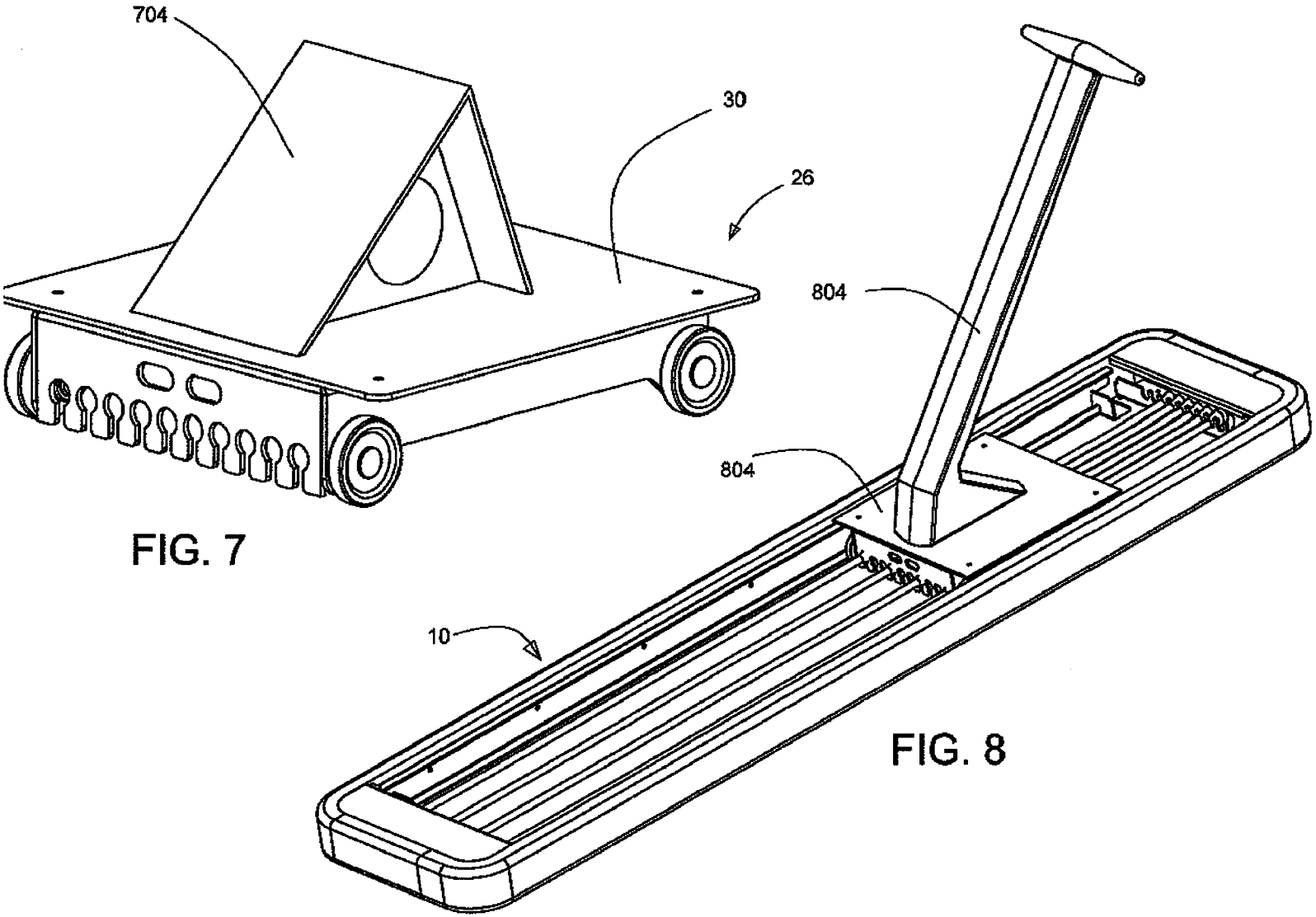
FIG. 7 shows the platform further comprising a starting block.
FIG. 8 shows the platform further comprising a handle.

FIG. 7 shows a perspective view of platform 26, with an added starting block 704 for exercises that require an angle which is substantially different from a straight angle between the user's foot and shin. Starting block 704 can be releasably attached to platform 26, for example by connecting to pre-prepared sockets 27 of FIG. 6 on flat top panel 30 of platform 26, or there can be a dedicated platform with a fixed starting block. The first option, of a removable block is more suitable for home usage, while the second option especially fits a professional place which has enough room for multiple platforms.

FIG. 8 shows a perspective view of platform 26, with an added handle 804, which is particularly useful for exercises such as upper extremity exercises. Similarly to starting block 704 of FIG. 7, the handle can be fixed or releasably attached to platform 26. The handle can be at a fixed angle or height, at a changeable angle or comprise a mechanism for changing the angle or height during the movement, similarly to the mechanism used in known rowing machines.

Figures 9A, 9B:
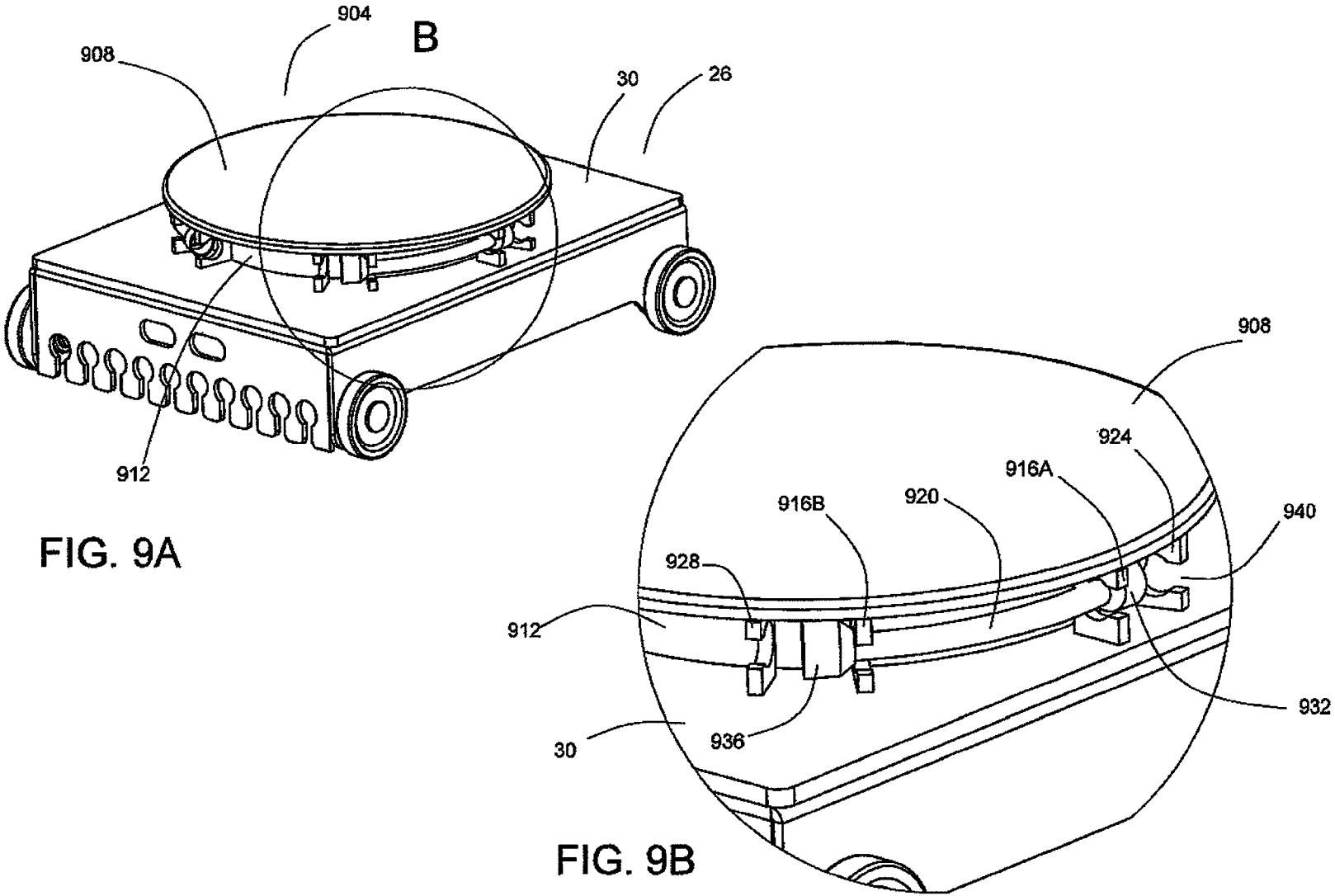
FIGS. 9A and 9B show the platform further comprising a rotational stand with resistance.

FIG. 9A is a perspective view of platform 26, with an added rotary plate 904, which is particularly useful for exercises that require rotation of the user's feet relatively to the pelvis or rotation of the user's trunk. Rotary plate 904 comprises a top plate 908 and a frame 912. Top plate 908 rotates relatively to frame 912 and platform 26. Frame 912 is fixed to top panel 30 of platform 26, either permanently or in a removable manner, comprising for example screws which can be opened and closed from the bottom of platform 26. The mechanism determining the effort required in order to rotate plate 908 relatively to platform 26 is shown in FIG. 9B. Holders 916A and 916B are attached both to plate 908 or both to frame 912. Holders 916A and 916B are used for storing a resistance medium 920 when the user wishes to apply no resistance. Resistance medium 920 comprises terminators 932 and 936. Holder 928 is attached to frame 912 and holder 924 is attached to rotary plate 908, and when the user wishes to apply resistance, he or she pulls terminator 932 from holder 916A and passes it through holder 924, or pulls terminator 936 from holder 916B and passes it through holder 928. Pulling both terminators is possible as well. Each of holders 916A, 916B, 924, and 928 comprise a keyhole having a neck 940 and a wider area 944, as detailed in association with FIG. 2A above. Connecting a resistance medium between holder 924 connected to rotary plate 908, and holder 928 connected to frame 912 hardens the rotation of plate 908 relatively to frame 912, and necessitates the user to exert more effort for that end. Variable degrees of resistance can be dictated, by using different resistance values for medium 920, as well as by changing, either permanently or in a changeable fashion the mutual radial distances between holders 924, 916A, 916B, and 928 determine the required effort. It is also possible to attach additional holders to rotary plate 908 and on frame 912, or to use a different mechanism for creating resistance to the relative motion between plate 908 and frame 912.

In a preferred embodiment, the top surface of the rotary plate is on the same plane as the top surface of platform 26. In this embodiment, the rotary plate is inseparable from the platform, but it can be fixed so that the same platform can be used for exercises that require fixed angles. Alternatively, rotary plate 904 is an add-on that is attached to platform 26 when required.

Figure 10:
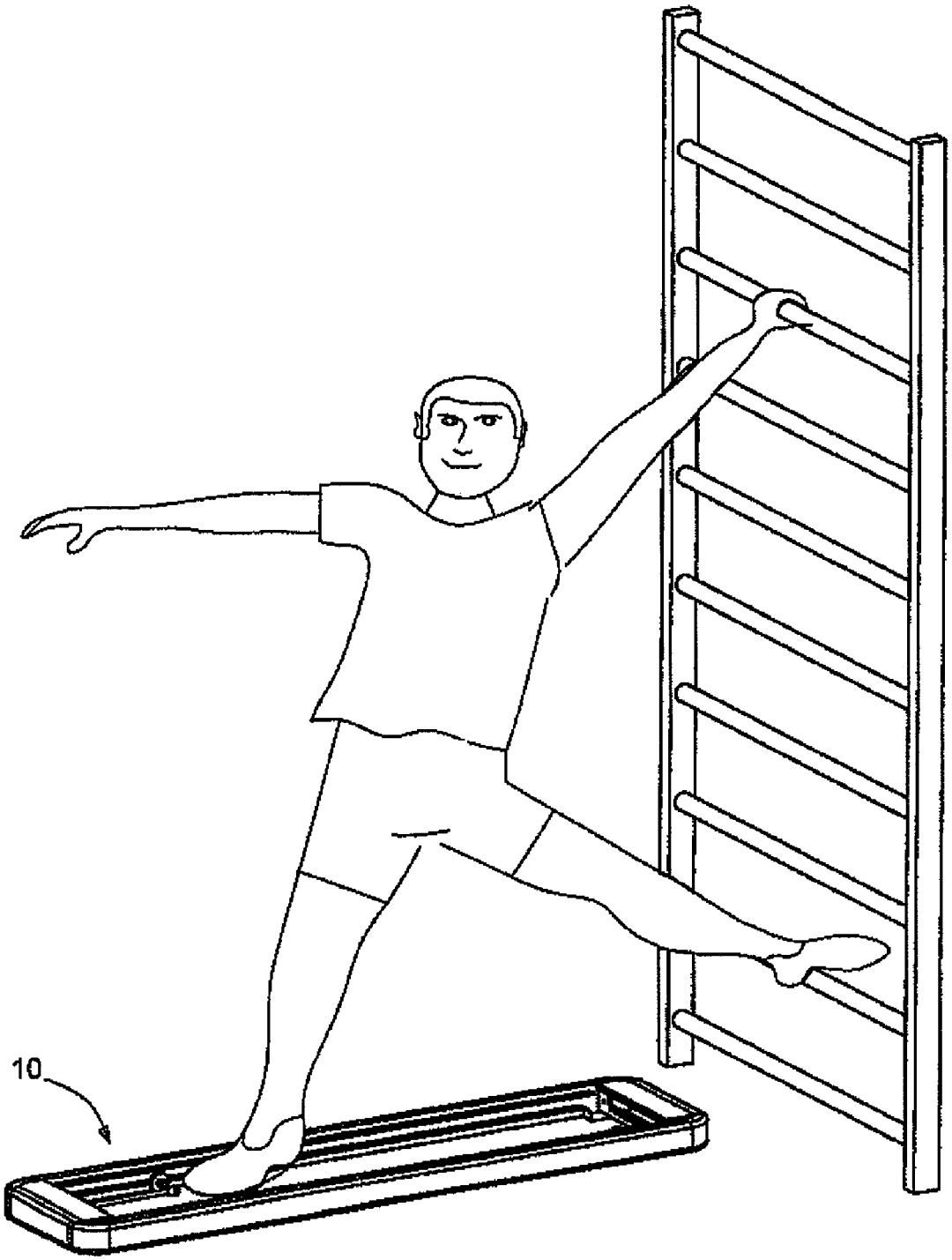
FIGS. 10 and 11 show a user using the disclosed invention in exemplary ways.
Figure 11:
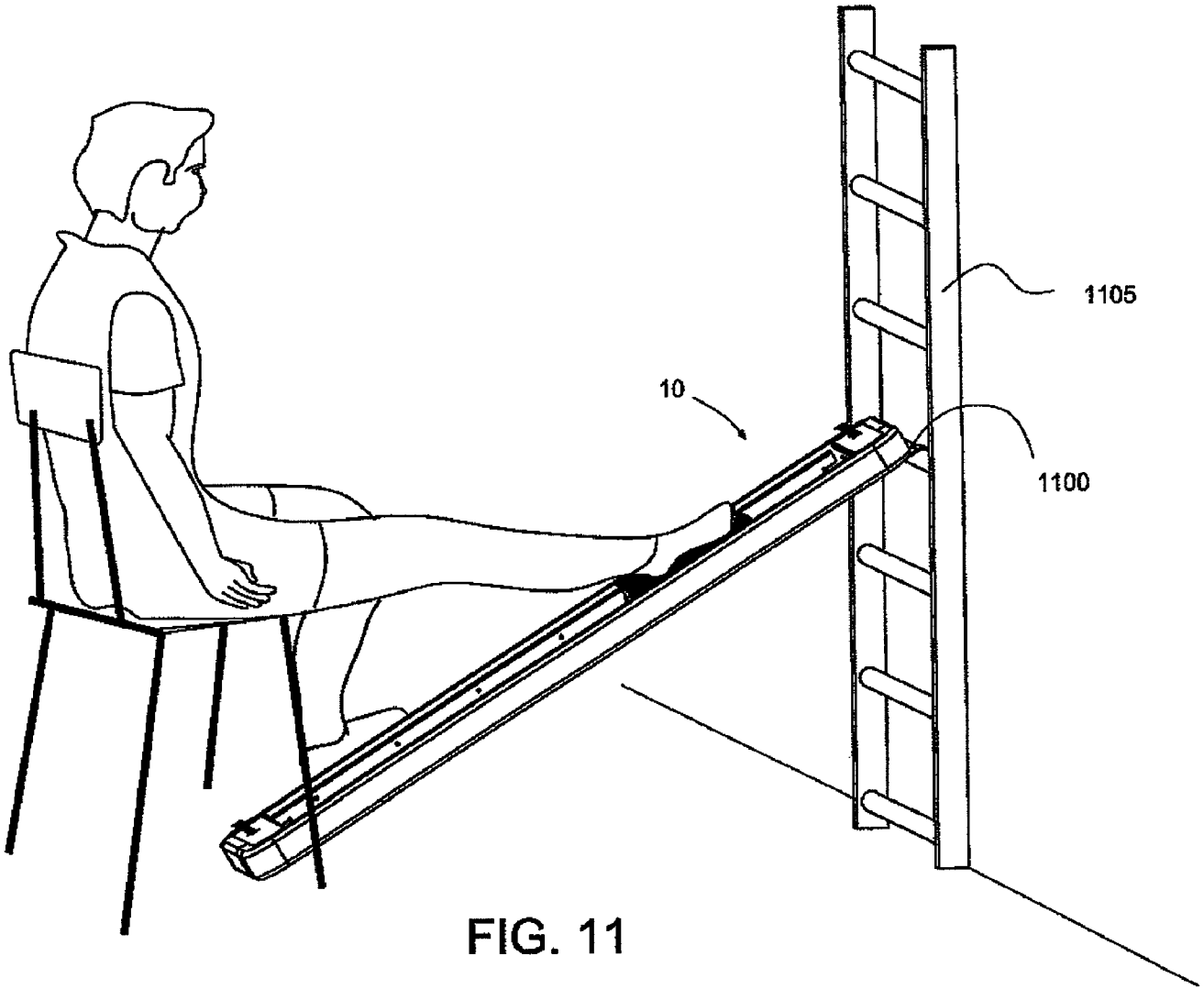

FIGS. 10 and 11 show possible uses of device 10 of the disclosed invention. In FIG. 10 the device is used in a flat position, while in FIG. 11 it comprises an extra hook 1100 and is mounted on an external stationary support, such as a ladder 1105 in an angle. It will be appreciated by people skilled in the art that the device can be used for numerous exercises activating multiple body parts. For example, a user can kneel on the floor next to the device, place his hands on the device and move the platform along the tracks back and forth, thus strengthening the abdominal muscles.

Figure 12:
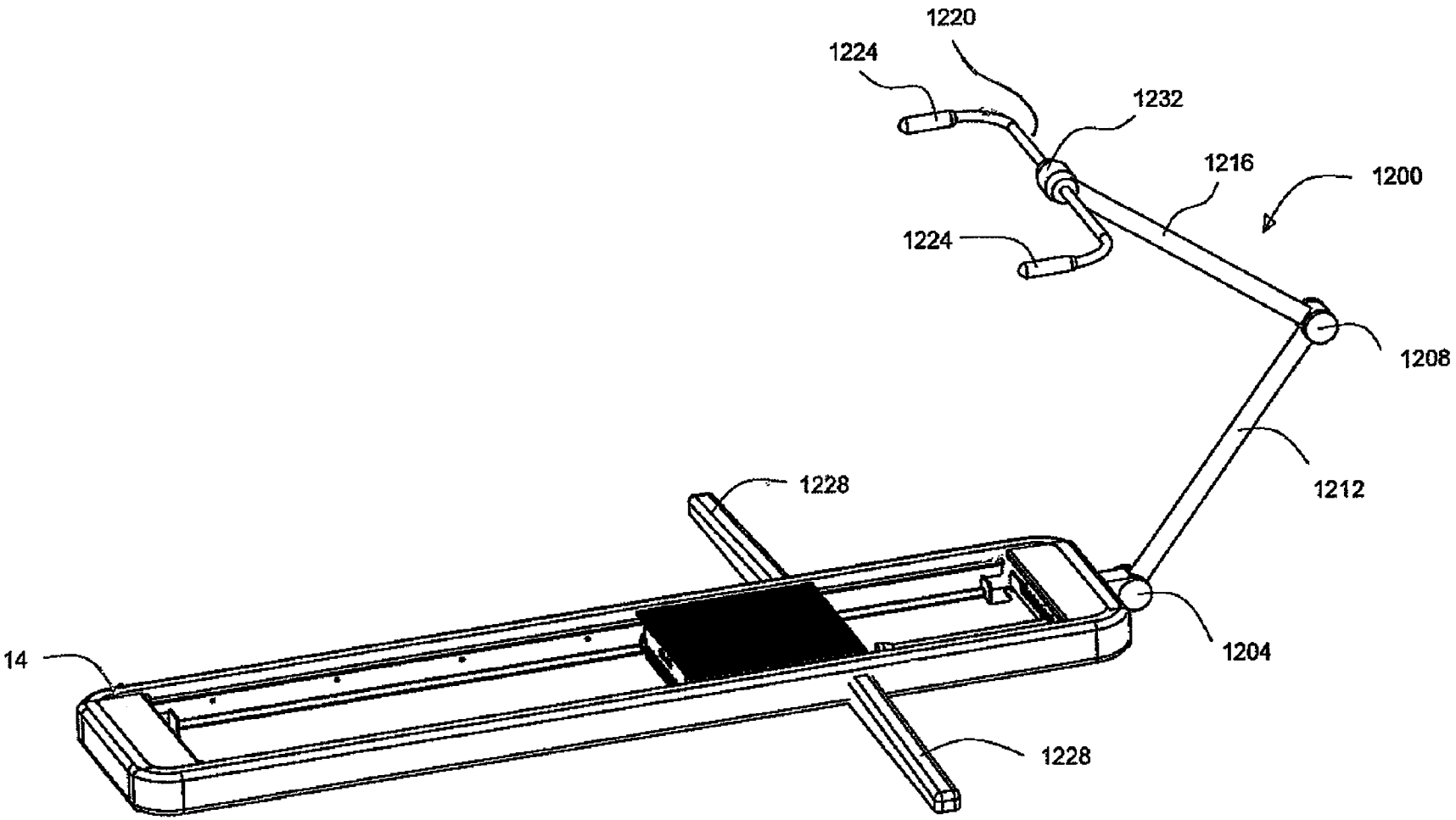
FIG. 12 is a perspective view of the disclosed exercise device with added handle and support bars.

FIG. 12 shows the device of the disclosed invention with an added handle, generally referenced as 1200. Handle 1200 is designed to enable a user of the disclosed device to hold, and thus obtain extra stability, counter force, or external fixation for certain exercises. Handle 1200 is optionally connected to any side of frame 14, or multiple handles can each be connected to multiple locations on frame 14. Handle 1200 comprises two longitudinal parts 1212 and 1216. Parts 1212 and 1216 are preferably made of rigid material such as metal, and between a few centimeters and one meter in length, each. The diameter of parts 1212 and 1216 is typically between a few millimeters and a few centimeters. Handle 1200 further comprises two gripping areas 1224, connected to each other through bar 1220. Bar 1220 connects to longitudinal part 1216 through fastening area 1232. Lower part 1212 connects to frame 14 through hinge 1204, and parts 1212 and 1216 preferably connect through hinge 1208. Hinges 1204 and 1208 provide flexibility in the height of gripping areas 1224 and in the distance between gripping areas 1224 and frame 14. Using one or more handles 1200 can elevate the center of gravity of the device when in use, so one or more support bars 1228 can be added along either side of the frame for improved stability. The support bars can also be added when no handle 1200 is used. Handles 1224 can be of a plurality of lengths in order to provide users with lateral support and protection. In a preferred embodiment, two 1200 units are connected on opposite sides of frame 14, and gripping areas 1224 of both 1200 support units are connected to form lateral bars in parallel to the long sides of frame 14. Gripping areas 1224 can alternatively be removed, creating single bar 1220, substantially parallel to the narrow sides of frame 14.

A user's guide is preferably provided with the device, instructing users about precautions, recommended exercises and the preferred ways to perform them. The user's guide can be printed on paper and categorized according to various parameters such as body part or another categorization, filmed or otherwise visualized on a video cassette or on a DVD wherein the exercises can also be categorized into chapters, or be disclosed by any other medium.

A preferred usage of the device comprises one-time, or seldom deployment of one or more preferred mediums, and an on-going usage with any subset of the mediums. The deployment step includes removing platform 26 from the device, turning it up-side down, placing the desired number and variety of mediums in a storage position between recess sequences 34A and 34B, such that bands 254 extend between opposite walls of the platform and terminators 258 protrude outwardly through the recesses, and placing platform 26 back on the tracks. Then, prior to performing each exercise or sequence of exercises, the user pulls one or more resistance mediums by terminator 258, from one or both sides of platform 26 to the opposite side of the device, without having to remove the platform from the device. Alternatively, the device can be used without connecting any resistance mediums between the platform and the frame, on either side of the platform or on both. The platform has to be removed from the device only if the user wishes to replace the available mediums, which is typically seldom done beyond initial deployment of the device.

Further add-ons and modifications can exist to the disclosed device. The device may comprise an elastic padding, such as a pad or a pillow-shaped element made of silicone, rubber or sponge which is useful for exercise groups, such as proprioceptive training. One or more padding elements can be placed on either side of the frame or on the platform. The padding is optionally implemented as an add-on with a structure suitable to securely attach to platform 26 via holes 27.

In another preferred embodiment, the wheels can be attached to the bottom of the platform, with one or more tracks stretching on the bottom of the device rather than on the sides of the frame. The resistance mediums can be implemented using principles other than an elastic band, such as a vacuum mechanism, a hydraulic mechanism, or the like. An inclination mechanism, providing a fixed or changeable inclination of one side of the device can be added to the device, for added strain on certain exercises. A fixed inclination can be provided by a simple wedge inserted under one side of the device, and a changeable inclination can be provided, for example, by a plate attached to a screwing mechanism, wherein the height of the plate on the screw determines the inclination. Alternatively, an elevating component can be used for elevating the device to a desired height, typically between a few centimeters and about one meter. The elevation component can be similar to an automobile jack, or comprise a plurality of such devices in order to provide greater support for the device, or elevate one side or corner of the device to a greater height than another side or corner. The elevation component can be activated manually, hydraulically, electrically or using any other energy source. Two platforms can be placed on the same track, for certain exercises such as straddling and joining the legs, or for mutual work of two persons, pulling each other by the hands.

The present device allows for exercises which can only be performed when the user slides one or two body parts back and forth, and has to exert force when sliding in both directions. For example, one exercise requires the user to set one limb in a stable manner, preferably on dedicated treading areas as seen on FIG. 3, and slide the other limb, thus changing the center of gravity of the body, back and forth, either forward and backward, or sideways. While going back and forth, the user has to exert force in order to slide the platform throughout the exercise and not just in one direction. Another example relates to an exercise in which the device is placed near a ladder, either in parallel or perpendicularly to the ladder, a user holds the ladder with one or more limbs, and slides the platform or platforms with one or more limbs back and forth, either forward and backward or sideways. Another configuration might be with the user placing one or two legs on one or two platforms and creating platform movement by using muscular activity only, without any external fixation. Due to the requirement to exert force in a precise and predetermined manner, in either direction or both directions, these exercises can be performed only with the disclosed device, which facilitates resistance in both directions.

The disclosed device is simple and non-expensive for manufacturing, can be used by trainees at their homes, or at studios under professional supervision. The device is versatile and enables the activation of multiple groups of muscles, while being safe for use and protecting the user from injuries. The device can further be submerged in water and used for under-water training which is beneficial to many users. The device can be enhanced by additions such as angled platforms, rotational platforms, handles and rails, hooks for hanging one side of the device on a ladder, and others. The disclosed device can be used in conjunction with sensors attached to the body of the user while performing exercises, the sensors transmitting information to a computer or a dedicated analysis device. The information can be related for example to the sensors' location which can be used to determine the user's posture. The analysis device provides feedback to the user on how to improve the way he or she are performing the exercise. For example, by instructing a user to make sure three sensors on his back are aligned, the user is encouraged to keep his back straight, or the like.

It will be appreciated by persons skilled in the art that the present invention is not limited to what has been particularly shown and described hereinabove. Rather the scope of the present invention is defined only by the claims which follow.

The invention claimed is:

1. An exercise device comprising:

a frame having two opposite ends;

at least one platform movably mounted on said frame such as to allow movement of the platform between the opposite ends of the frame;

at least one track extending between the ends of the frame, a portion of the at least one track comprising a cover operable to engage a part of the platform; and at least one resistance medium having one end connectable to the platform and a second end connectable to one of said two opposite ends of the frame and at least one other resistance medium having one other end connectable to the platform and a second other end connectable to the other one of said two opposite ends of the frame such that the platform is neutrally positioned between the opposite ends when the mediums are connected between the platform and the ends of the frame;

wherein each resistance medium is stored under and carried by the platform, in parallel to a top panel of the platform when not in use, and wherein the platform is provided with two spaced apart platform frame members extending downward from opposite ends of the platform, each member having a sequence of platform attaching elements, and wherein each resistance medium passes straight through the two platform frame members and has an equilibrium length equal or shorter than the distance straight between the two spaced apart sequences to allow storage of each resistance medium beneath the platform by connecting one end of each of the resistance mediums to an attaching element of one of the two sequences of platform attaching elements and the other end of each of the resistance mediums to another attaching element of the other sequence of platform attaching elements.

2. The device of claim 1 wherein each resistance medium comprises an elongated elastic member having opposite ends and a rigid conic shaped terminator fastened to each end of the elastic member.

3. The device of claim 2 wherein each of the sequences of the platform attaching elements are keyhole-like openings in the platform frame members each adapted to receive one end of a resistance medium.

4. The device of claim 1 wherein each resistance medium is provided with a visual indicator for indicating resistance value.

5. The device of claim 4 wherein the visual indicator is color or texture.

6. The device of claim 1 wherein the platform comprises a set of wheels for moving the platform along said frame.

7. The device of claim 1 further comprising an elongated stopper hole strip fastened to the frame and extending between the frame ends and an at least one removable stop pin positionable in at least one stopper hole in the stopper hole strip.

8. The device of claim 1 further comprising a rotational stand removably fastened to the platform.

9. An exercise device comprising:

a frame having two opposite ends;

at least one platform movably mounted on said frame such as to allow movement of the platform between the opposite ends of the frame; and at least one resistance medium having one end connectable to the platform and a second end connectable to one of said two opposite ends of the frame and at least one other resistance medium having one other end connectable to the platform and a second other end connectable to the other one of said two opposite ends of the frame such that the platform is neutrally positioned between the opposite ends when the mediums are connected between the platform and the ends of the frame;

wherein each resistance medium is stored under the platform, in parallel to a top panel of the platform when not in use, and wherein the platform is provided with two spaced apart sequences of platform attaching elements, and wherein each resistance medium has an equilibrium length equal or shorter than the distance between the two spaced apart sequences to allow storage of each resistance medium beneath the platform by connecting one end of each of the resistance mediums to an attaching element of one of the two sequences of platform attaching elements and the other end of each of the resistance mediums to another attaching element of the second sequence of platform attaching elements, wherein the frame includes at least one track extending between the ends of the frame and wherein the track comprises a cover, said cover at least partially covering an at least one part of the platform.

10. An exercise device comprising:

a frame having two opposite ends and a pair of spaced parallel tracks extending therebetween;

a platform movably mounted on the tracks between the ends of the frame;

at least one of the tracks having a cover at least partially covering at least one part of the platform;

a first attachment element and an opposing second attachment element extending downward from opposite ends of the platform in a spaced apart relation, each element having a series of spaced openings therethrough; and a plurality of elastic resistance members mounted to and between the first and second spaced elements through the openings, each elastic resistance member having one end connectable to the first element through one of the openings and a second end connectable to the second element through another one of the openings when the resistance member is not in use;

wherein each end may be removably pulled further through the one of the first or second elements and fastened to an end of the frame closest to the platform element through which the end of the elastic member has been pulled, and wherein at least one other resistance member is removably passed through the other one of the first or second elements and fastened to the end of the frame closest to the other one of the first or second elements such that the platform can be neutrally positioned between the opposite ends of the frame when two or more elastic members are connected between the platform and the ends of the frame.

11. The device according to claim 10 wherein the elastic resistance members are held between the first and second elements when not attached to either end of the frame.

12. The device according to claim 10 wherein each element is a generally flat plate and the openings are keyway shaped open slots each for receiving one of the elastic resistance member ends therein.

13. The device according to claim 10 wherein the platform has a generally rectangular shape with a pair of wheels mounted thereto for movement of the platform along each track.

14. The device according to claim 10 wherein each frame end has a plurality of spaced vertical slots therein each for receiving and holding one of the ends of the resistance members.

15. The device according to claim 10 wherein each of the elements is an L shaped bracket plate having one portion fastened to the bottom of the platform and another portion having open keyway shaped slots therethrough for receiving and holding the elastic resistance member ends.

* * * * *